United States Patent [19]

Englund

[11] 4,155,610

[45] May 22, 1979

[54] UNLOCKING AND EXPELLING MECHANISM FOR A DRAWER IN A CABINET

[75] Inventor: John S. Englund, Ektorp, Sweden

[73] Assignee: Hugin Kassaregister AB, Stockholm, Sweden

[21] Appl. No.: 806,620

[22] Filed: Jun. 15, 1977

[30] Foreign Application Priority Data

Aug. 10, 1976 [SE] Sweden ..... 76089184

[51] Int. Cl.[2] ..... A47B 88/00; E05C 5/00

[52] U.S. Cl. ..... 312/319; 312/222; 312/333; 292/111

[58] Field of Search ..... 312/319, 333, 222; 292/111, 65, D72; 49/216

[56] References Cited

U.S. PATENT DOCUMENTS

| | | | |
|---|---|---|---|
| 792,003 | 6/1905 | Catron | 49/216 |
| 1,052,854 | 2/1913 | Staples | 312/333 |
| 1,389,981 | 9/1921 | Randall | 312/319 |
| 1,854,178 | 4/1932 | Butler | 312/333 |
| 2,098,486 | 11/1937 | Clark | 312/333 |
| 3,048,435 | 8/1962 | Marco | 292/111 |
| 3,107,958 | 10/1963 | Robbins | 312/333 |
| 3,647,251 | 3/1972 | Brown et al. | 292/111 |

FOREIGN PATENT DOCUMENTS

| | | | |
|---|---|---|---|
| 2268142 | 4/1974 | France | 292/DIG. 72 |

*Primary Examiner*—Victor N. Sakran

*Attorney, Agent, or Firm*—Darby & Darby

[57] ABSTRACT

The invention refers to an unlocking and expelling mechanism for a drawer in a cabinet or a frame, preferably in cash registers, wherein a lock stud is secured to the back end of the drawer and is engaged, when the drawer is pushed in against a spring force, by a locking hook mounted on a pivot shaft rotatably supported in a fixed bracket. The shaft has a lateral projection for blocking a slidable latch which can be retracted from the projection by manually operating an electromagnet, so that the shaft will be free to rotate the hook to release the stud and allow expelling of the drawer. The improvement consists in providing a movable and guided connection between the hook and the pivot shaft so as to, when the shaft begins to rotate, the hook is imparted a reciprocating movement in its longitudinal direction. The hook has an aperture having a guiding edge for cooperation with a lifting pin fixed in the cabinet, said edge being inclined for lifting the hook in its forwards stroke caused by said shaft.

4 Claims, 4 Drawing Figures

UNLOCKING AND EXPELLING MECHANISM FOR A DRAWER IN A CABINET

The present invention refers to an unlocking and expelling mechanism for a drawer in a cabinet, as in cash registers, a lock stud secured to the back end of the drawer being, against the force of a compressed spring acting on the drawer, engaged by a locking hook mounted on a pivot shaft rotatably supported in a bracket fixed to the cabinet and having a radial projection for bearing against a latch retractable by means of an electromagnet.

In cash registers, an expelling force acting on the drawer in the order of 5 pounds is normally required, for which value the compression spring is to be dimensioned. This implies that the frictional forces to be overcome for retracting the latch from its engagement with said radial projection, when the drawer is pushed in, are considerable. For that reason, the conventional designs of the unlocking and expelling mechanism have required the use of electromagnets of the power-current type. These electromagnets are relatively expensive and bulky; the greatest disadvantage, however, is the necessity of feeding the electromagnets from a separate voltage source (normally the line voltage of 220 V) as the power source used for providing the remaining functions of the cash register is of the low-tension type (typically 17 V) and, further, supplies only a limited effect.

These as well as other drawbacks are overcome by the mechanism of the invention, characterized in that the locking hook is in movable and guided connection with said pivot shaft such, that it upon the rotation of the shaft is imparted a reciprocating movement longitudinally of the hook, and includes one member in an edge-pin slide connection, the second member of which is stationary and guides the hook in an upwards direction upon the projection thereof through the rotation of the pivot shaft.

An embodiment of the invention is described below while referring to the accompanying drawings.

Figure 1:
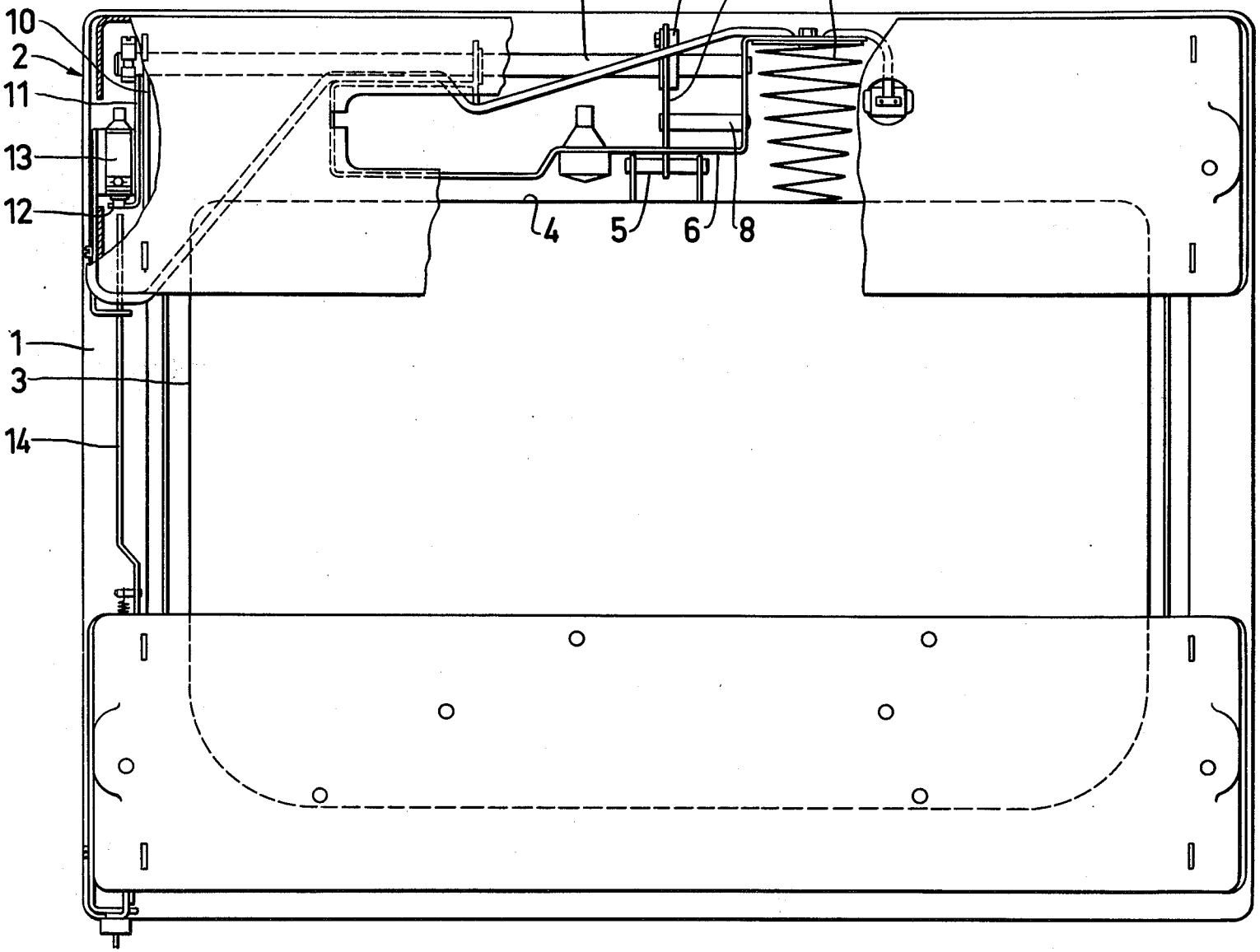
FIG. 1 is a plan view of a cabinet-drawer combination including the mechanism of the invention, having certain parts broken away.

Referring to FIG. 1, a drawer 3 is slidably mounted on the bottom 1 of a cabinet 2. At the rear edge 4 of the drawer a lock stud 5 is provided. An angled plate or bracket 6 extending upwards from the bottom of the cabinet serves as a support for one end of a compression spring 7, the other end of which acts on the rear edge 4 of the drawer in the pushed-in position thereof, shown in the Figure.

Figure 2:
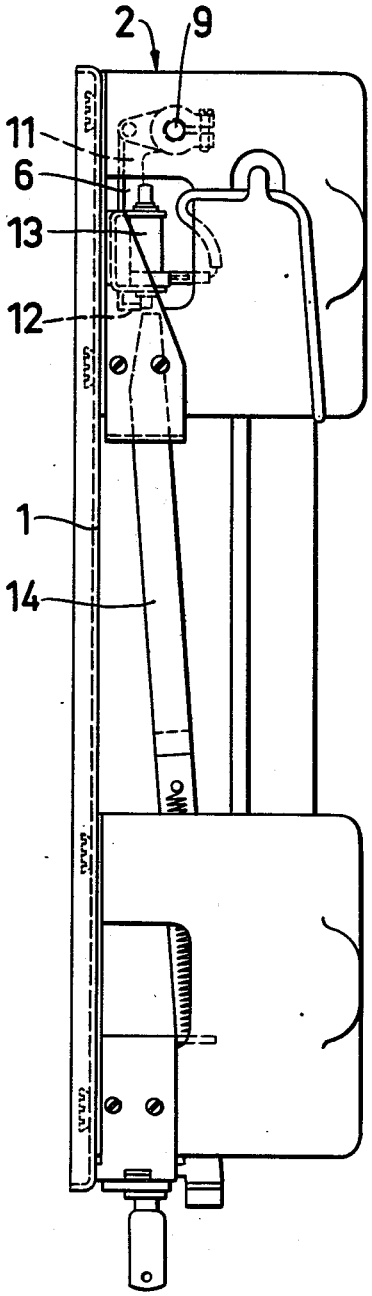
FIG. 2 is a side view of the combination.
Figure 3:
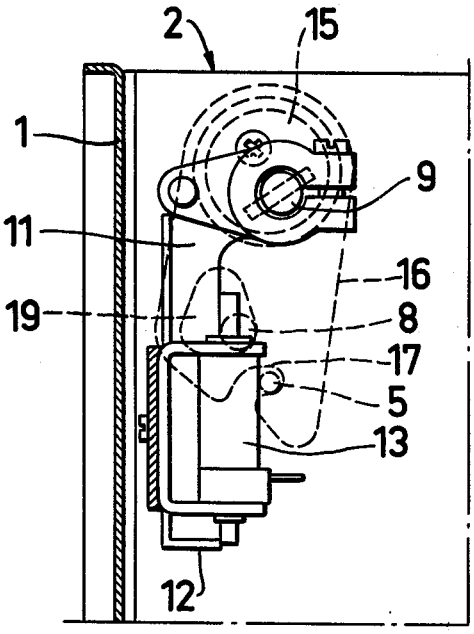
FIG. 3 shows, on a larger scale, a partial view of the arrangement in FIG. 2.

The plate (bracket) 6 also carries a lifting pin 8 and has a pivot point for one end of a pivot shaft 9, the other end of which is pivoted in a support plate 10. Adjacent the support plate there extends radially from the shaft a lever 11 having a bent end 12 (compare also FIG. 3). An electromagnet 13 has, when not energized, its armature extending across said bent end against the action of a spring force (not shown). The retraction of the armature — or a bar connected thereto — can also be effected manually by means of a release arm 14, as is best shown in FIG. 2.

Figure 4:
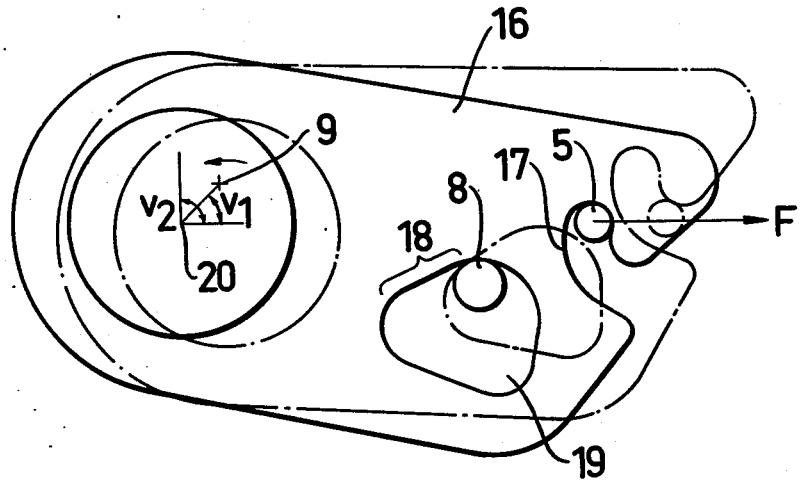
FIG. 4 is a schematic view of the main parts of the mechanism to explain the operation thereof.

At a position opposite to the lock stud 5 the shaft 9 carries an excenter hub in the shape of a circular disc 15. The disc is rotatably mounted in a locking hook 16, the special shape of which is clearest shown by FIG. 4 (compare also FIG. 3). At its front, i.e. to the right in FIG. 4, the hook has an open, curved slot 17 for gripping the lock stud 5 of the drawer. Adjacent the slot the hook is provided with an aperture 19, having a guiding edge 18 inclined upwards (as seen from the fulcrum of the hook), for receiving the fixed lifting pin 8. — In the initial position shown in full lines, which position is the locking position, the pivot shaft 9 should be so adjusted relatively the hook that the line connecting the shaft 9 with the effective fulcrum 20 of the hook encloses an acture angle $v_1$ with the longitudinal axis of the hook passing through the lock stud 5.

The operation of the arrangement described above is as follows: When the drawer is fully pushed in and locked, the spring 7 seeks, by applying the horizontal force F, to increase the distance from the lock stud 5 of the drawer to the support plate 6 of the cabinet and, thus, to the pivot shaft 9. Due to the acute angle $v_1$ mentioned above (FIG. 4) the operative lever arm of the force F acting on the shaft 9 will, however, be reduced, and consequently also the torque of the lever 11 will be reduced. This fact means a correspondingly reduced pressure of the end 12 of the lever 11 against the armature of the electromagnet 13 so that upon the energizing of the magnet its armature can be easily retracted while overcoming the frictional resistance. Then the shaft 9 will be free to rotate up to the final angle $v_2$ while progressively increasing the torque on account of the excenter arrangement. The excenter arrangement will obviously also operate to displace the locking hook 16 to the position indicated by phantom lines in FIG. 4. During this movement the inclined guiding edge 18 slides on the fixed lifting pin 8 so that the hook is rotated upwards to enable the lock stud 5 to pass out from the slot 17, as illustrated in the Figure. The inclination of the guiding edge 18 also provides for a very substantial "gear reduction" of the friction in the contact point between the slot 17 in the hook and the lock stud 5.

When the drawer again is pushed in, all part referred to above are automatically restored to their initial positions indicated by full lines.

From the above it is clear that, for a certain required expelling force on the drawer, the electromagnet used for unlocking can be dimensioned for a marked less effect (and for the low voltage of the cash register) than the effect required by prior art systems. Moreover, the compression spring used with the invention serves, in addition to the expelling of the drawer, also to the unlocking thereof, whereas for the last-mentioned operation an additional spring is required by the conventional mechanism.

The invention is not restricted to the embodiment described above but various modifications are obvious to one skilled in the art, especially as regards the form and function of the locking hook. The excenter arrangement shown could be replaced by some other device, e.g. a slot-pin connection, to produce the reciprocating movement of the hook.

A pin secured to the hook and a corresponding, fixed aperture — which must not necessarily be closed — could replace the illustrated guiding connection formed by means of a hook aperture and a fixed lifting pin. As a whole, each element included in the embodiment shown could be replaced by an other element having equivalent operative features.

What I claim is:

1. In an unlocking and expelling mechanism for a drawer which slides in a cabinet or a frame of the type including a lock stud secured to the back end of the drawer, a compressing spring positioned between said drawer back end and a wall of the cabinet, a locking hook mounted on a pivot shaft rotatably supported in a bracket fixed to the cabinet, said hook engageable with said stud when the drawer is pushed in against the action of the compressing spring, said pivot shaft having a radial projection for bearing against a latch slidably mounted in the cabinet, and a means for retracting said latch from the engagement with said radial projection, the improvement comprising:

means connecting the locking hook with the pivot shaft in a movable and guided relationship for producing a reciprocating longitudinal movement of said hook upon rotation of said shaft; said hook including a first member in an edge-pin slide connection, said connection including a single second member fixedly mounted in the cabinet to guide the hook continuously in a stud-disengaging direction by a wedging action upon the forward projection thereof caused by the rotation of the pivot shaft.

2. A mechanism as in claim 1, wherein said first member is an opening in the hook, and the second member is a lfting pin fixed to said bracket.

3. A mechanism as in claim 2, wherein said opening has a closed configuration.

4. In an unlocking and expelling mechanism for a drawer in a cabinet or a frame, including a lock stud secured to the back end of the drawer, a compressing spring positioned between said back end and the back wall of the cabinet, a locking hook mounted on a pivot shaft rotatably supported in a bracket fixed to the cabinet, said hook being engageable with said stud when the drawer is pushed in against the action of the compressing spring, said pivot shaft having a radial projection for bearing against a latch slidably mounted in the cabinet, and means for retracing said latch from the engagement with said radial projection, the improvement comprising:

means connecting the locking hook with the pivot shaft in a movable and guided relationship for producing a reciprocating longitudinal movement of said hook upon rotation of said shaft;

said hook including a first member in an edge-pin slide connection, said connection including a second member stationary in the cabinet to guide the hook in a stud-releasing direction upon the forward projection thereof caused by the rotation of the pivot shaft; and said means connecting the locking hook with the pivot shaft including a circular disc rotatably mounted in a corresponding circular recess in the hook, said disc being eccentrically mounted on said pivot shaft such that the line connecting the axis of said shaft and the operative fulcrum of the hook forms, in the locking initial position of said hook, an acute angle with the longitudinal axis of the hook.

* * * * *